US006844814B2

(12) United States Patent
Chin et al.

(10) Patent No.: US 6,844,814 B2
(45) Date of Patent: Jan. 18, 2005

(54) WIRELESS SENSOR APPARATUS AND METHOD

(75) Inventors: Kwan Wu Chin, Dluwich Hill (AU); Raad Raad, Cringila (AU)

(73) Assignee: Motorola, Inc., Schaumburg, IL (US)

( * ) Notice: Subject to any disclaimer, the term of this patent is extended or adjusted under 35 U.S.C. 154(b) by 270 days.

(21) Appl. No.: 10/292,302

(22) Filed: Nov. 12, 2002

(65) Prior Publication Data

US 2004/0090326 A1 May 13, 2004

(51) Int. Cl.[7] ..... G08B 1/08

(52) U.S. Cl. ..... 340/539.22; 340/539.11; 340/573.1; 340/573.4; 340/693.5; 340/825.49; 340/825.54; 375/130; 375/347; 455/438; 455/442; 455/444; 455/453

(58) Field of Search ..... 340/539.22, 539.11, 340/573.1, 573.4, 693.5, 825.49, 825.54; 375/130, 347; 455/438, 442, 444, 453

(56) References Cited

U.S. PATENT DOCUMENTS 5,905,461 A * 5/1999 Neher ..... 342/357.07
6,178,328 B1 * 1/2001 Tang et al. ..... 455/447
6,792,276 B1 * 9/2004 Butovitsch et al. ..... 455/453

* cited by examiner

*Primary Examiner*—Jeffery Hofsass
*Assistant Examiner*—Tai Tan Nguyen

(57) ABSTRACT

Wireless sensor platforms (10), when deployed, can ascertain whether they can meaningfully participate in communications with more than one cluster (22, 23) of such devices. When true, such multi-cluster platforms can serve as bridge nodes to facilitate the passing of data collected from one cluster to or through another cluster. In a preferred embodiment, the platforms serving as bridge modes (24 and 25) utilize a communication schedule that imposes no greater work load than the load the platform would otherwise have served as an ordinary node, and preferably the workload is considerably reduced. This aids in ensuring that the portable power reserves of the bridge nodes will support bridge operations for at least as long as the clusters are otherwise functioning.

25 Claims, 6 Drawing Sheets

10

WIRELESS SENSOR APPARATUS AND METHOD

TECHNICAL FIELD

This invention relates generally to wireless communications and more particularly to wireless sensor platforms and systems.

BACKGROUND

Wireless sensors are known. Such devices typically comprise an integral device having one or more sensors (to sense any of a wide variety of conditions and parameters) and a transmitter or transceiver to support wireless telemetry of sensor data. Many such devices further include a portable power supply (such as a battery pack and/or a solar cell array) and/or control logic to facilitate various actions and responses.

Networks of such wireless sensors have also been proposed. Proliferation of corresponding system designs has occurred as various enabling technologies (such as microelectromechanical system (MEMS) design to facilitate the provision of very small, accurate, cost effective, and low power sensor mechanisms) have become available. Pursuant to one deployment scheme, a plurality of wireless sensors are strewn over a geographic area of interest (such as, for example, a farm or ranch). These sensors then communicate with one another pursuant to a pre-arranged or self-organized communication protocol and schedule. In many such proposals, the wireless sensors communicate in this fashion pursuant to a relatively fixed or otherwise predictable schedule. So configured, the wireless sensors are then able to assume a so-called sleep mode during intervening periods in order to conserve power.

In many wireless sensor networks, one or more collection points serve to receive the sensor data as generated by the various wireless sensors that comprise the network. For a variety of reasons, however, such collection points are often not able to receive such information directly from each wireless platform (for example, the collection point may be located beyond the transmission range of a given wireless sensor). One useful proposal suggests relaying data from one wireless sensor to another as needed in order to transport sensor data from a given source to a desired endpoint. In a relatively simple configuration, such an approach may prove acceptable.

There are other circumstances where such an approach remains insufficient, however. In some systems, groups of wireless sensors are organized into clusters (such clusters may be differentiated by range, purpose, wireless communications protocol and/or modulation, or any number of other causes or criteria). Relaying data from one cluster to a collection point via another cluster can be accomplished using so-called bridge nodes (these being wireless sensors that are able to function compatibly in both clusters), but such an approach gives rise to a new set of problems. In particular, the communications duty cycle of such a bridge node will typically at least double as compared to the wireless sensors that otherwise comprise these clusters. This occurs because the bridge node becomes active during the communication cycles of both clusters that it serves to link. As a result, the bridge nodes will deplete their portable power source more rapidly than other platforms within these clusters and therefore fail sooner. When this occurs, the link between the clusters breaks and the collection point no longer has access to data still being collected by the now-stranded cluster of wireless sensors.

One simple solution would be to provide the bridge nodes with a larger portable source. Such an approach, however, dictates that some wireless platforms within a given deployment are different than others. This can raise costs significantly, both to provide and supply a plurality of platforms and to ensure that each type of sensor is deployed properly (that is, to ensure that bridge nodes are positioned where they can, in fact, usefully serve as a bridge node). Problems such as these tend to militate against the use of such a solution.

BRIEF DESCRIPTION OF THE DRAWINGS

The above needs are at least partially met through provision of wireless sensor apparatus and method described in the following detailed description, particularly when studied in conjunction with the drawings, wherein.

Figure 1:
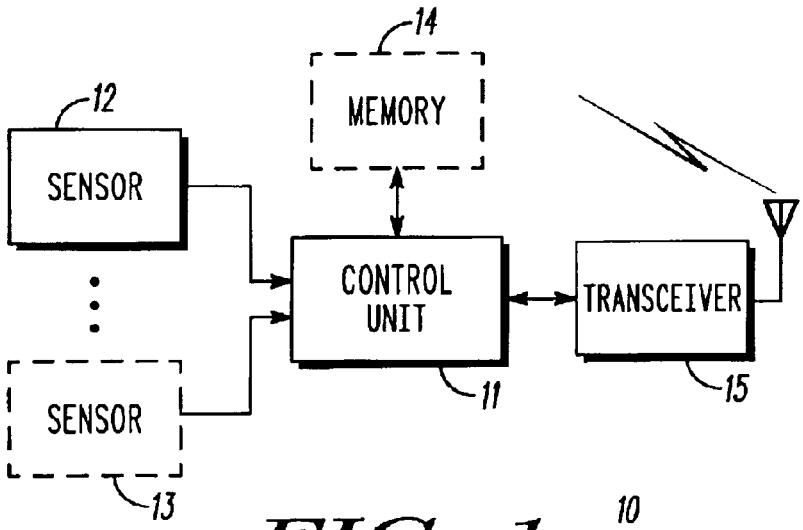
FIG. 1 comprises a block diagram of a wireless sensor platform as configured in accordance with an embodiment of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are typically not depicted in order to facilitate a less obstructed view of these various embodiments of the present invention.

DETAILED DESCRIPTION

Generally speaking, pursuant to these various embodiments, a wireless sensor platform can operate to determine whether it can detect wireless communications amongst a plurality of sensor clusters. When true, the wireless sensor platform identifies the communications schedule for each such cluster (such communications schedules identifying, in one embodiment, times when the wireless sensor platforms that comprise each cluster are to be powered up and communicating or be ready to communicate amongst themselves). The wireless sensor platform then determines a communication schedule for itself that represents a reduced time requirement for communications as compared to a combination of the first communications schedule and the second communications schedule. In one embodiment, the newly determined communication schedule will serve to both conserve the power reserves of the wireless sensor platform while simultaneously facilitating a passing of data from one cluster to the other.

In one embodiment, the wireless sensor platform can determine an ability of other wireless sensor platforms to also inter-communicate with these same clusters (or, in another embodiment, with at least one other cluster) and to use that information when devising and using its communications schedule. In one embodiment the wireless sensor platforms that can serve to link multiple clusters can divide the offering of such services amongst themselves over time. This will permit the power requirements to support such linking services to be spread over multiple platforms and thereby serve to preserve the individual power reserves of each such platform. In another embodiment, such multi-cluster capable wireless sensor platforms can transfer data amongst themselves to thereby further facilitate the transfer of data within a multi-cluster deployment of such platforms.

So configured, wireless sensor platforms that have inter-operable communications access to multiple clusters and/or other platforms that possess such access can serve as data bridges to facilitate the flow of data throughout the network. By establishing such services in a dynamic fashion, multiple platforms can be leveraged to thereby permit power usage for any given wireless sensor platform to be substantially reduced or minimized. So configured, bridge platforms will typically retain useful power reserves at least as long as the wireless sensor platforms that do not serve this purpose. Furthermore, by facilitating such configurations in a dynamic fashion, the wireless sensor platforms can be essentially identical to one another to thereby achieve corresponding economies of scale and ease of deployment.

Referring now to FIG. 1, a suitable wireless sensor platform 10 will typically include a control unit 11 such as a microprocessor, microcontroller, programmable gate array, or other programmable logic platform (if desired, of course, and particularly where the intended and desired service of the wireless sensor platform 10 is likely to remain continuously specific and well defined, a more hard-wired non-programmable architecture can be utilized instead). The control unit 11 can be programmed or otherwise configured and adapted to permit effectuation of the various processes and operational modes described herein. A sensor 12 (or sensors 13) couples to the control unit 11 and provides data regarding whatever parameter the sensor(s) 12(13) detects. A wide variety of sensors are presently known and more are sure to be introduced. It should be understood that these teachings are not limited to any particular sensor technology or sensed parameter. It should also be understood that, to the extent that multiple sensors are used, mixed sensor technologies and/or monitoring of multiple sensor parameters are also readily accommodated within these teachings.

If desired, one or more memories 14 are coupled to the control unit 11 (to store, for example, sensor data as received from the sensor 12 (or sensors) and/or sensor data as received from other wireless sensor platforms and/or clusters as described below (it would also be possible to include such memory integral to the control unit 11 if desired). Such a memory 14 can also serve to retain programming for the control unit 11 and/or communications schedule information as developed pursuant to these embodiments.

At least one transceiver 15 couples to the control unit 11 to permit wireless communications with, for example, other wireless sensor platforms. Such a transceiver can facilitate communications via radio frequency-based emissions, light frequency-based emissions, or any other wireless medium as appropriate to a given application. In addition, there are no particular limitations with respect to the modulation technique and/or communications protocol as regards these embodiments. Instead, the designer is free to select whichever techniques and approaches may best serve the immediate needs of a given deployment. If desired, additional transceivers (and/or transmitters or receivers) can also be provided. Depending upon the needs of the moment, such additional platforms can provide redundant back-up communications services and/or can facilitate parallel communications using alternative technologies. For example, a wireless sensor platform 10 could be provided with a first transceiver that utilizes amplitude modulation and a second transceiver that utilizes frequency modulation techniques. So configured, the platform would be able to communicate with other sensor platforms using either approach, either in parallel or in seriatim fashion.

So configured, the wireless sensor platform 10 can readily support various modes of operation. For example, pursuant to a first mode of operation, the wireless sensor platform 10 can detect the wireless communications of any number of clusters of wireless sensor platforms and also determine the communications schedule to be used by each such cluster. Pursuant to a second mode of operation, the wireless sensor platform 10 can interact with other wireless sensor platforms that are also able to interact wirelessly with a plurality of such clusters. For example, such platforms can self-organize during such a mode of operation and determine which amongst them are to serve as bridge platforms. Pursuant to a third mode of operation, the wireless sensor platform 10 can serve as a bridge platform and inter-operate with at least one cluster to provide a data bridge service. When serving as a bridge platform, and in accordance with a preferred embodiment, the wireless sensor platform 10 will observe a communications schedule that is no more demanding, and usually less frequent, than the communications schedule that the platform 10 would have to observe when maintaining communications with all of the available clusters (in effect, bridge services are preferably shared across a number of wireless sensor platforms 10 to thereby leverage their collective power reserves).

Figure 2:
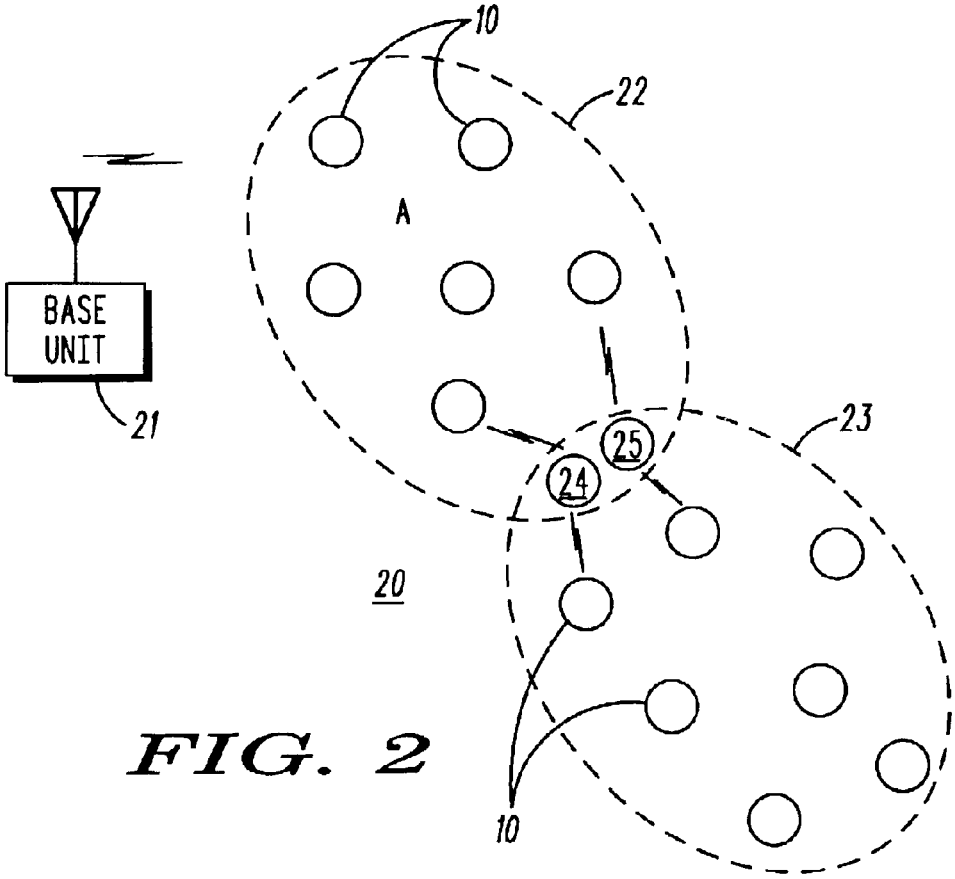
FIG. 2 comprises a schematic top plan view of a deployment of wireless sensor platforms as configured in accordance with an embodiment of the invention.

Referring now to FIG. 2, a deployed sensor network 20 will typically include one or more base units 21 that serve to ultimately receive the sensor data from the dispersed wireless sensor platforms 10. Such a base unit 21 can be a fixed-location platform or can be mobile as appropriate to the needs of a given application. Similarly, the base unit 21 can operate autonomously or under the control of one or more operators (either on-site or remotely). The deployed wireless sensor platforms 10 themselves are geographically dispersed (in this example) over a geographic area. Also in this example, and pursuant to ordinary cluster architecture and process, the dispersed platforms 10 self-organize themselves into two clusters denoted here as cluster A 22 and cluster B 23 (as already noted, there are numerous ways and various cluster-membership criteria by which such clusters can be identified and organized). For purposes of this illustration, it will be presumed that each wireless sensor platform 10 within a given cluster 22 or 23 is able to wireless communicate with every other wireless sensor platform 10 that also comprises a part of that cluster. It will also be presumed that such communications occur pursuant to a specific communication schedule (which schedule can be previously determined and/or dynamically determined as part of the self-organization activity) in order to permit the wireless sensor platforms 10 to effect a sleep mode of operation during at least some other periods.

For purposes of this illustrative example, there are two wireless sensor platforms 24 and 25 that are able to communicate with platforms 10 belonging to both clusters 22 and 23. Pursuant to these embodiments, such wireless sensor platforms 24 and 25 are able to determine their inter-operation capacity and to work together to exploit that capacity to permit data as collected by one cluster (such as cluster B 23, which cluster, in this example, is beyond an effective communications range of the base unit 21) to be passed on to the other cluster (such as cluster A 22, which cluster, in this example, is suitably positioned to pass on data from cluster B 23 to the base unit 21). And, as already noted, in a preferred embodiment such wireless sensor platforms 24 and 25 further work together to establish a communications schedule that will permit them to support such bridge services while simultaneously conserving their on-board power reserves to ensure availability of the bridge service for the full operating lifetime of the bulk of the wireless sensor platforms 10 that comprise each cluster 22 and 23.

Figure 3:
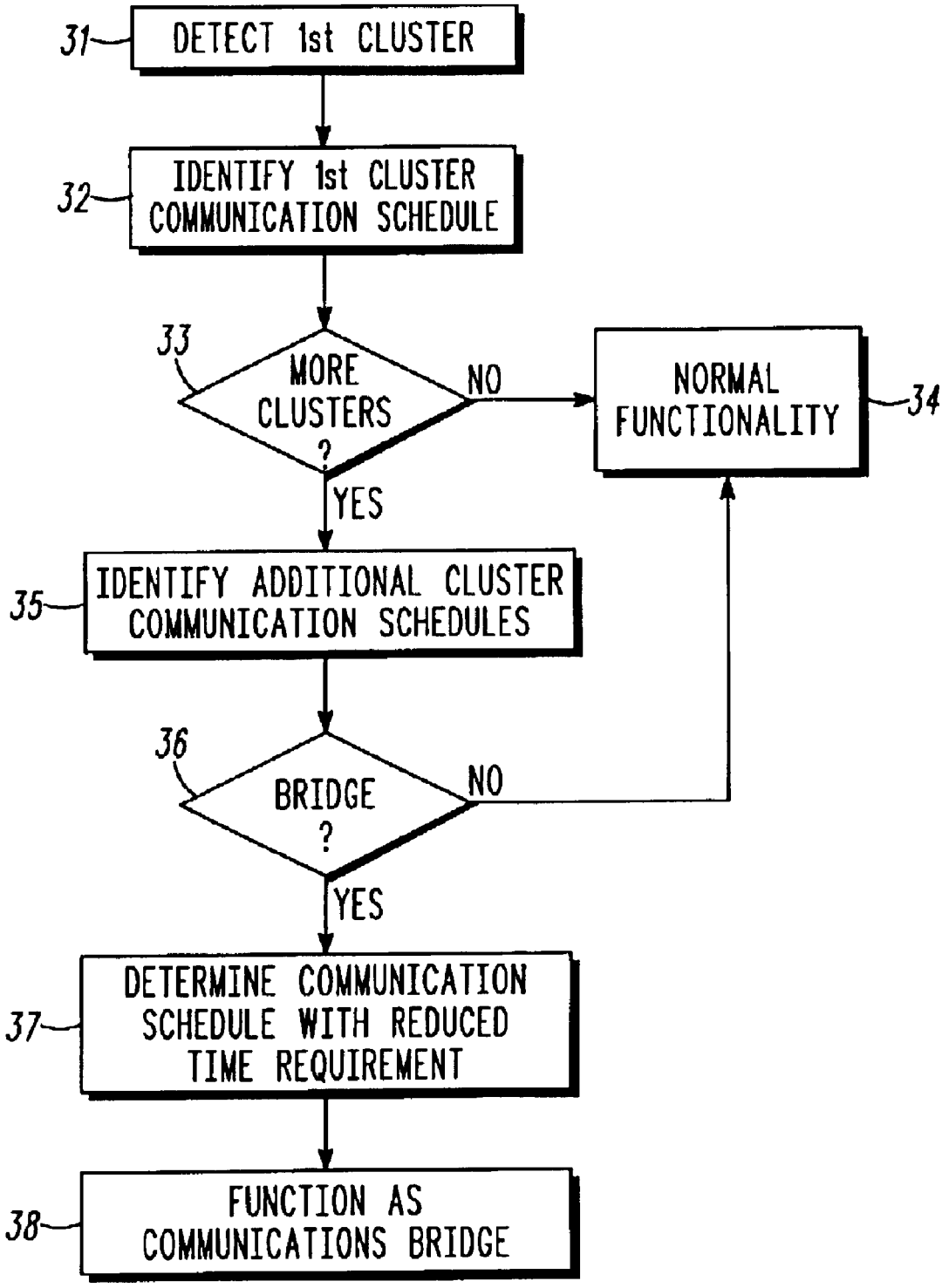
FIG. 3 comprises a flow diagram as configured in accordance with an embodiment of the invention.
Figure 4:
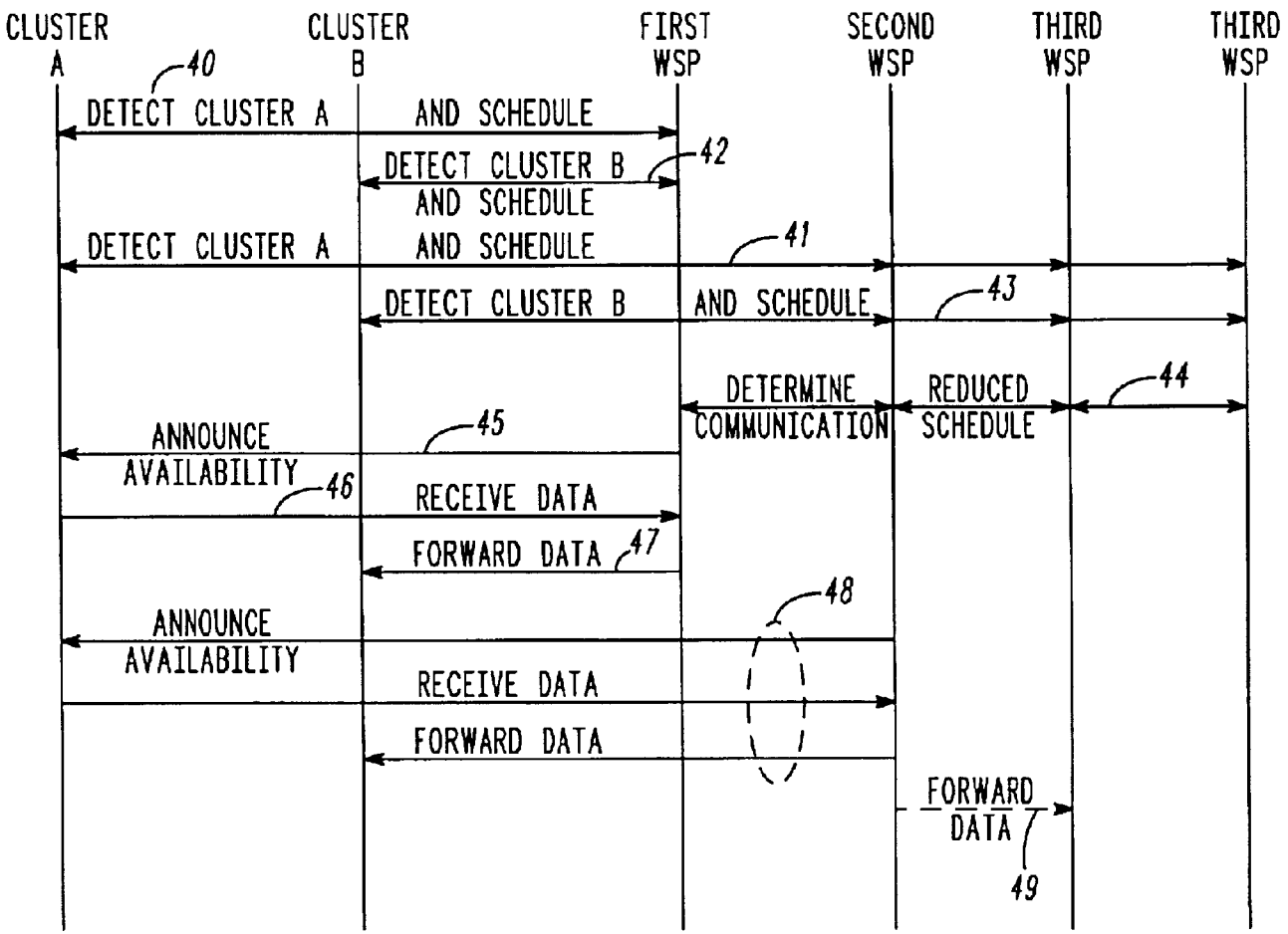
FIG. 4 comprises an illustrative communications timing diagram as configured in accordance with an embodiment of the invention.

Referring now to FIGS. 3 and 4, a general process to effect such behavior along with an illustrative example will be described. Upon initial deployment (or as otherwise triggered or initiated in accordance with the needs of a given application) a wireless sensor platform searches for and detects 31 the communications of a first cluster of other wireless sensor platforms (presuming, of course, that such a first cluster exists). Upon detecting 31 such a cluster, the process then identifies 32 the communications schedule by which the wireless sensor platforms of that cluster communicate with one another. As one illustrative example, and referring momentarily to FIG. 4, a first wireless sensor platform (WSP) can detect the communications 40 of cluster A and then ascertain the communications schedule for that cluster A. Similarly, a second, third, and fourth wireless sensor platform in this example also detect such communications 41 and likewise obtain the corresponding communications schedule.

Figure 5:
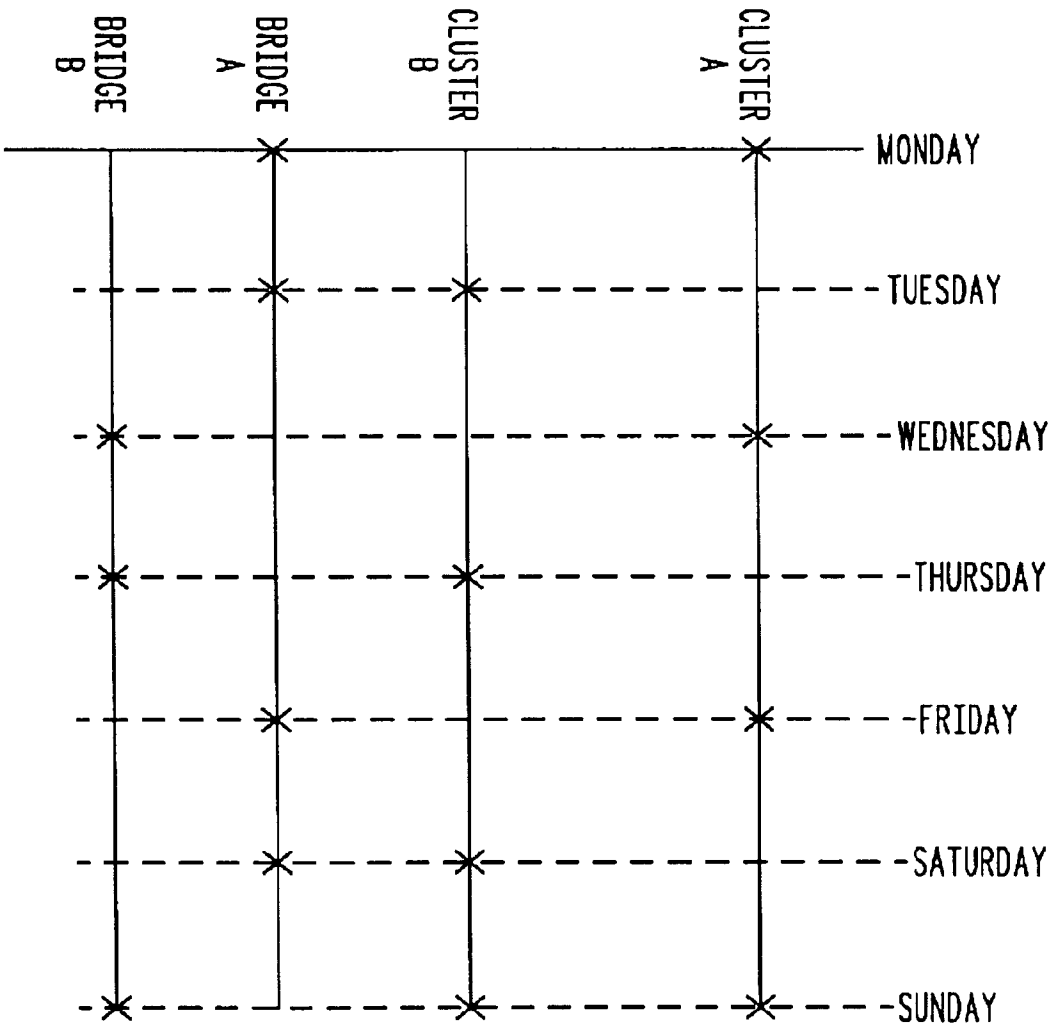
FIG. 5 comprises a communication schedule as configured in accordance with an embodiment of the invention.

Referring again to FIG. 3, the process then searches for other clusters. If no additional clusters are detected 33, then the wireless sensor platform proceeds in accord with its normal functionality 34 as well understood in the art. When the platform detects 33 other sensors, however, the process again provides for identifying 35 the communication schedules for each such cluster. To continue the example of FIG. 4, the first wireless signal platform, having already detected and characterized cluster A, then notes the communications and determines the communications schedule 42 of cluster B. In similar fashion, the other three wireless sensor platforms also detect the communications and corresponding schedule 43 of cluster B. So configured, these four wireless sensor platforms are now each apprised of two clusters and the communications schedule by which such clusters organize their communications. To illustrate this concept with a simple example, FIG. 5 presents cluster A as having communications scheduled for Mondays, Wednesdays, Fridays, and Sundays while cluster B has communications scheduled for Tuesdays, Thursdays, Saturdays, and Sundays. (It should be emphasized that these are simple examples being provided for explanatory purposes only.)

Referring again to FIG. 3, the process next permits a wireless sensor platform to determine 36 whether it should serve as a bridge (between, for example, clusters and/or other bridges). When, for whatever reason, a particular candidate bridge platform is not scheduled for bridge service, that particular wireless sensor platform can simply proceed with its normal functionality 34. Such a decision may occur, for example, when the candidate bridge platform has a relatively small power reserve as compared to other candidates, when the sheer number of candidates is more than sufficient to enable the provision of appropriate bridge services without this particular candidate's participation, when no bridge services are necessary, or any number of other reasons.

For those wireless sensor platforms that are to serve as bridge platforms, however, the process provides for determination 37 of a communications schedule for that particular platform. To continue the illustrative example of FIG. 4, and pursuant to one embodiment, the four wireless sensor platforms that comprise the candidate bridge platforms can communicate 44 amongst themselves to determine which of them, if any, should serve as bridge platforms (as well as for which cluster(s)/bridge(s)) and pursuant to what communications schedule). All of these decisions, but especially the scheduling determinations, can be based upon a variety of criteria, including but not limited to the frequency or periodicity by which sensor data is to be forwarded from a given cluster, the memory available to each wireless sensor platform (as is available to store, for example, data to be passed from one cluster to another), the population size of the clusters in question, the respective energy reserves of the candidate bridge platforms, the communication schedules of the various clusters (including, for example, the mechanism by which so-called pseudo-random wake-up times are scheduled), and so forth.

In general, the communications schedule for a given bridge platform should be no more demanding than the communications schedule for that particular wireless sensor platform would be were it to conduct ordinary functions with the clusters in question (and preferably should be less demanding). For example, in the illustrative example at hand, and referring again momentarily to FIG. 5, a first wireless sensor platform serving as bridge A can be assigned to communicate with cluster A on Mondays and Fridays and with cluster B on Tuesdays and Saturdays. This represents four scheduled communications windows per week which is only half the total number of scheduled communications that would be required if this platform were to communicate with both clusters pursuant to the full-time schedules of both clusters. In effect, this bridge A is communicating no more frequently on a weekly basis than it would be communicating if it were operating as part of only a single cluster. This example also illustrates that a second wireless sensor platform, serving as bridge B, can be scheduled to communicate with cluster A on Wednesdays and Sundays and cluster B on Thursdays and Sundays. Again, the total number of communications as scheduled for the platform as a bridge platform comprises a reduced schedule as compared to a non-bridge schedule for this same platform.

Returning again to FIG. 3, the wireless sensor platforms that are selected and scheduled as bridge platforms then proceed to function 38 as communication bridges between clusters and/or other bridges. So configured, of course, the bridge platforms can be placed in a partial or full sleep mode for at least a substantial amount of the time that is outside the reduced time schedule for communications to thereby reduce their respective power consumption. When serving as a bridge platform, of course, these platforms generally serve to receive data from one cluster and to pass that data on to another cluster. For example, as illustrated in FIG. 2, data from cluster B 23 can be passed to cluster A 22 via one of the wireless sensor platforms 24 and 25 that are positioned to serve as bridge platforms.

Returning again to the illustrative example of FIG. 4, the first wireless sensor platform, operating as a bridge platform during a scheduled communication period for cluster A, can transmit an announcement message 45 to indicate its presence and availability to receive data to be forwarded to cluster B. With appropriate programming, the wireless sensor platforms of cluster A can respond by transmitting their data 46 to the first wireless sensor platform. Such data can then be locally stored as necessary. Later, when the first wireless sensor platform communicates as scheduled with cluster B, the cluster A data is then transmitted 47 to cluster B to complete the forwarding process via the bridge. These same communications (including the availability announcement, receipt of data, and forwarding of data) with these same clusters are then done at other times by the second wireless sensor platform. So configured, the bridge duties are shared between two wireless sensor platforms to accrue the benefits already noted above.

Figure 6:
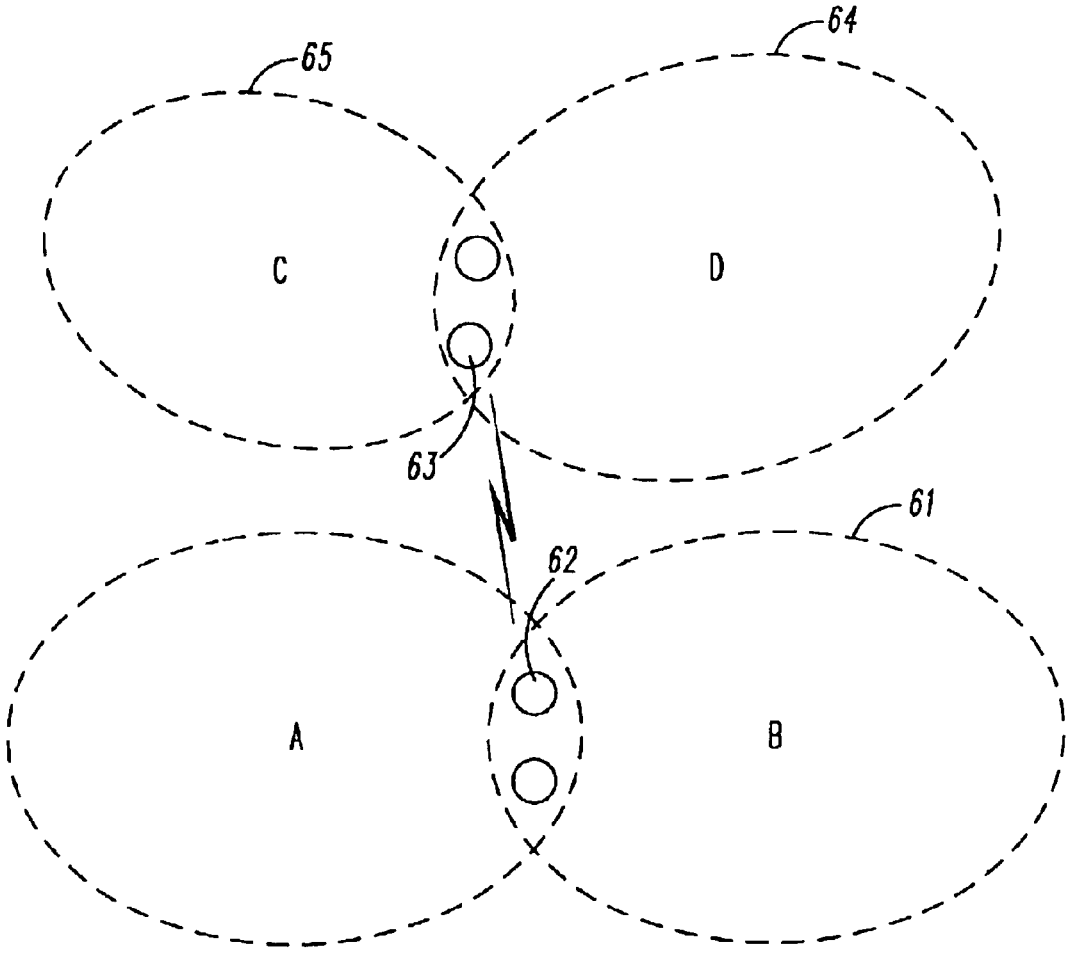
FIG. 6 comprises a schematic top plan view of a deployment of wireless sensor platforms as configured in accordance with another embodiment of the invention.

In the scenarios presented above, the wireless sensor platforms are able to identify other clusters with which they can communicate. It is also possible, however, for such a wireless sensor platform to also sense other bridge platforms, which bridge platforms may be communicating with one or more other clusters that are not otherwise available to the sensing platform. It is within the scope of these teachings to facilitate a transfer of data via these connections as well. For example, with reference to FIG. 6, data from a first cluster B 61 can be transferred via a bridge platform 62 to either of two other clusters C and D 65 and 64 through another bridge platform 63. Such connection opportunities can be ascertained at the same time that a given wireless sensor platform detects other clusters and/or other bridge platform candidates, and the scheduling of communications with such platforms can be similarly determined when the communications schedule for a given platform is otherwise determined as described above. So configured, and as illustrated in FIG. 4, data 49 can be readily forwarded from one bridge platform to another.

Figure 7:
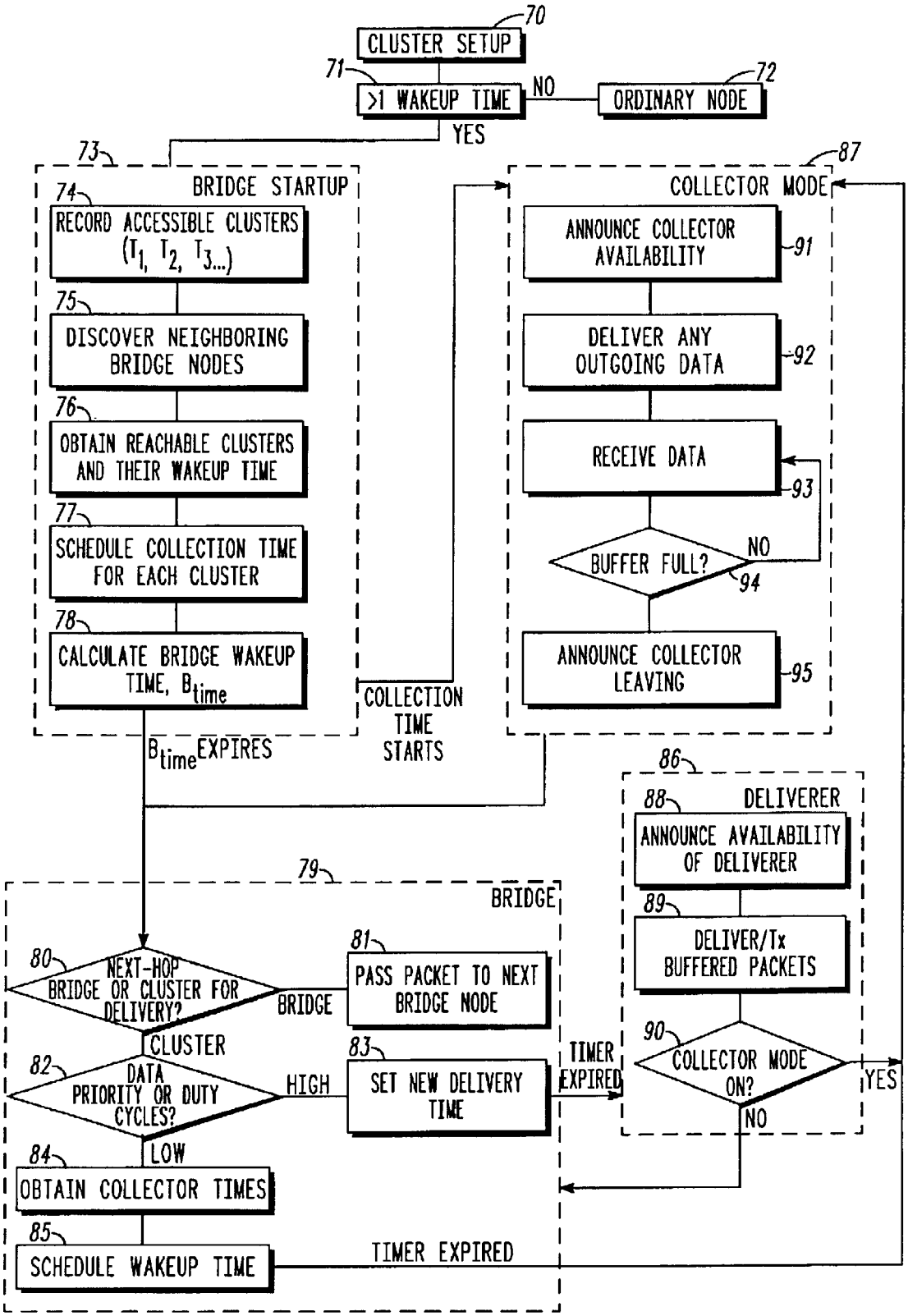
FIG. 7 comprises a detailed flow diagram as configured in accordance with an embodiment of the invention.

As already noted, there are numerous ways to specifically embody a given wireless sensor platform and/or sensor network to behave compatibly with these various teachings. FIG. 7 presents one particular illustrative approach. Pursuit to this embodiment, a given wireless sensor platform engages in its ordinary cluster setup routine 70 (for example, upon initiation or deployment) and then determines 71 whether scheduled communications in the form of wakeup times for have found for more than one cluster. When only one such cluster has been found, the platform behaves as an ordinary node 72 within that cluster. When more than one cluster has been scheduled, however, the platform initiates a bridge startup mode 73.

During the bridge startup mode 73, the platform notes and records 74 corresponding indicia for all accessible clusters and then seeks to discover 75 any neighboring bridge nodes as otherwise noted above. Information regarding reachable clusters (and the corresponding wakeup times/communication schedules for such clusters) is obtained 76 and shared amongst the neighboring bridge nodes and a resultant collection time schedule formed 77 for each cluster for which this particular platform will serve as a bridge node. The platform then calculates 78 a corresponding bridge wakeup time (or times) $B_{time}$ following which the platform can enter a powered down mode of operation to thereby conserve energy.

When the bridge wakeup time expires a bridge mode 79 becomes active. In this mode, the platform determines 80 whether it has a next-hop bridge or cluster data packet available. When a bridge data packet exists, the platform passes 81 the packet to a next bridge node (for example, as described earlier). When a cluster data packet exists, the platform accesses 82 the priority and/or other duty cycle indicia that may apply to the data in question. When a high priority or other indicia of desired rapid service exists, a new delivery time is set 83 and the process switches to the deliverer process 86 described below. When a low priority exists, collector times are obtained 84 and a corresponding wakeup time scheduled 85. When the appropriate wakeup time arrives, the process switches to the collector mode 87 described below.

Pursuant to the deliverer mode 86, the platform transmits 88 its announcement regarding its availability to deliver forwarded data, following which the platform transmits 89 buffered packets that include the data to be forwarded. The platform then determines 90 whether a collector mode is on or off. When off, the process 86 returns to the bridge mode 79. When the collector mode is on, however, the process 86 switches to the collector mode 87.

Pursuant to the collector mode 87, the platform transmits 91 its announcement regarding its availability as a data collector. As an optional step, the platform can then deliver 92 any outgoing data that it might otherwise have and can then receive 93 data from the cluster in question (at least until the platform's resident buffer memory becomes full 94). Upon concluding this process, the platform then transmits 95 an announcement that it is leaving.

So configured, a wireless sensor platform can serve as an ordinary wireless sensor platform within a cluster of similar devices or can support a specialized bridge service to thereby facilitate extension of the effective range of a given deployment of such devices. Significant economies of scale can be realized in part because each device can be made essentially identical to every other device (with changes obviously being appropriate where necessary to support different sensor technologies, wireless technologies, and so forth). Furthermore, no special additional hardware elements need be provided to permit such a device to function as a bridge nor is a larger capacity energy reserve necessary.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept. For example, when a given bridge platform can determine that two clusters happen to share a common communication window (as can happen either pursuant to a set schedule or by happenstance when two pseudo-random-based schedules coincidentally produce a common wake-up time), that bridge platform can effect its services by using that common window to again aid in minimizing its own on-time requirements. To illustrate, in FIG. 5 it can be seen that both cluster A and cluster B have a communication scheduled on Sunday. By utilizing this particular window of commonly scheduled communications, the bridge platform can serve as a bridge while simultaneously likely minimizing its own required service time.

We claim:

1. A method for use by a sensor platform having at least one sensor and a wireless transceiver, comprising:

detecting wireless communications amongst a first plurality of sensor platforms and identifying a first communications schedule by which the first plurality of sensor platforms so communicate;

detecting wireless communications amongst a second plurality of sensor platforms and identifying a second communications schedule by which the second plurality of sensor platforms so communicate;

determining a communication schedule that comprises a reduced time requirement for communications as compared to a combination of the first communications schedule and the second communications schedule but that is at least partially coincident with the first communications schedule and the second communications schedule such that the sensor platform can communicate from time to time with the first plurality of sensor platforms and the second plurality of sensor platforms.

2. The method of claim 1 wherein the sensor platform includes only a portable power supply.

3. The method of claim 1 wherein:

identifying a first communications schedule by which the first plurality of sensor platforms so communicate includes identifying times when the first plurality of sensor platforms are scheduled to be powered up and at least one of receiving and transmitting; and identifying a second communications schedule by which the second plurality of sensor platforms so communicate includes identifying times when the second plurality of sensor platforms are scheduled to be powered up and at least one of receiving and transmitting.

4. The method of claim 1 and further comprising:

placing the sensor platform in at least a sleep mode for at least a substantial amount of time that is outside the communication schedule that comprises a reduced time requirement to thereby reduce power consumption.

5. The method of claim 1 wherein determining a communication schedule that comprises a reduced time requirement includes communicating with at least one other sensor platform that can also detect wireless communications amongst the first plurality of sensor platforms and the second plurality of sensor platforms.

6. The method of claim 1 and further comprising using the communication schedule that comprises the reduced time requirement to facilitate passing information obtained from the first plurality of sensor platforms to the second plurality of sensor platforms.

7. The method of claim 6 and further comprising using the communication schedule that comprises the reduced time requirement to facilitate passing information obtained from the second plurality of sensor platforms to the first plurality of sensor platforms.

8. The method of claim 1 and further comprising:

using the communication schedule that comprises the reduced time requirement to communicate with the first plurality of sensor platforms, including at least:

transmitting a message that identifies the sensor platform as being available to receive outbound messages that are to be forwarded to the second plurality of sensor platforms.

9. The method of claim 8 wherein using the communication schedule that comprises the reduced time requirement to communicate with the first plurality of sensor platforms further includes at least:

receiving at least one message from at least one sensor platform of the first plurality of sensor platforms that is to be forwarded to the second plurality of sensor platforms.

10. The method of claim 9 and further comprising:

using the communication schedule that comprises the reduced time requirement to communicate with the second plurality of sensor platforms, including at least:

transmitting at least a portion of the at least one message from the at least one sensor platform of the first plurality of sensor platforms to at least one sensor platform of the second plurality of sensor platforms.

11. The method of claim 1 wherein determining a communication schedule that comprises a reduced time requirement includes determining the communication schedule as a function, at least in part, of at least one of:

sensor data forwarding periodicity;

memory availability of the sensor platform;

population size of the first plurality of sensor platforms;

energy reserves of the sensor platform; and the first and second time schedules.

12. The method of claim 1 and further comprising:

determining an ability to communicate with at least one other sensor platform that can also detect communications amongst more than one plurality of sensor platforms using the communication schedule that comprises the reduced time requirement to communicate with the at least one other sensor platform.

13. The method of claim 12 wherein using the communication schedule that comprises the reduced time requirement to communicate with the at least one other sensor platform includes receiving at least one message from the at least one other sensor platform, which at least one message comprises a message that was at least partially received by the at least one other sensor platform from one of the plurality of sensor platforms and that is intended to be forwarded on by the sensor platform.

14. The method of claim 12 wherein using the communication schedule that comprises the reduced time requirement to communicate with the at least one other sensor platform includes transmitting at least one message to the at least one other sensor platform, which at least one message comprises a message that was at least partially received by the sensor platform from the first plurality of sensor platforms and that is intended to be forwarded on by the at least one other sensor platform.

15. A wireless sensor platform, comprising:

a wireless transceiver;

a control unit operably coupled to the wireless transceiver and having at least a first mode of operation, a second mode of operation, and a third mode of operation, wherein:

the first mode of operation comprises detecting wireless communications of a plurality of clusters, wherein each such cluster comprises a plurality of wireless sensor platforms, and determining a communications schedule as corresponds to each of the clusters;

the second mode of operation comprises interacting with other wireless sensor platforms that are also able to interact wirelessly with a plurality of such clusters;

the third mode of operation comprises inter-operating with at least one of the plurality of clusters on a less frequent basis than is otherwise compliant with the communications schedule that corresponds to the at least one of the plurality of clusters.

16. The wireless sensor platform of claim 15 wherein the less frequent basis is based, at least in part, upon the second mode of operation interaction with other wireless sensor platforms that are also able to interact wirelessly with a plurality of such clusters.

17. The wireless sensor platform of claim 15 wherein the control unit comprises bridge means for determining that the wireless sensor platform can serve as a communications bridge between clusters of wireless sensor platforms and for scheduling service as a communications bridge to thereby share such service with other wireless sensor platforms that can also serve as a communications bridge to thereby facilitate spreading the service over a plurality of wireless sensor platforms.

18. The wireless sensor platform of claim 15 wherein the control unit comprises collection means for causing the wireless sensor platform to transmit its availability to collect data from wireless sensor platforms of a cluster, such that the wireless sensor platform can then later re-transmit the data.

19. The wireless sensor platform of claim 15 wherein the control unit comprises delivery means for causing the wireless sensor platform to re-transmit data that has been previously collected from wireless sensor platforms of at least one cluster.

20. A method of obtaining sensed data from a plurality of wireless sensor platforms that are spatially dispersed, comprising:

forming a plurality of clusters comprised of wireless sensor platforms that share at least one predetermined cluster-membership criteria, wherein the wireless sensor platforms that comprise each such cluster communicate amongst themselves pursuant to a corresponding schedule;

identifying any wireless sensor platforms that have wireless inter-operability with more than one of the clusters to provide candidate bridge platforms;

scheduling at least some of the candidate bridge platforms to serve as bridge platforms by inter-operating with at least two of the clusters, wherein each of the bridge platforms inter-operates with multiple clusters at substantially no greater duty cycle than a wireless sensor platform performing in ordinary fashion will inter-operate with other wireless sensor platforms that belong to its cluster.

21. The method of claim 20 and further comprising causing a bridge platform to transmit a message to indicate when the bridge platform is available to receive messages from wireless sensor platforms of a given cluster.

22. The method of claim 21 and further comprising causing the bridge platform to receive messages from wireless sensor platforms of the given cluster.

23. The method of claim 22 and further comprising causing the bridge platform to re-transmit the messages to wireless sensor platforms of another cluster to thereby forward the messages.

24. The method of claim 20 and further comprising:

identifying any candidate bridge platforms that have wireless inter-operability with another candidate bridge platform, wherein only one of the any candidate bridge platform and the another candidate bridge platform has wireless inter-operability with a specific one of the clusters.

25. The method of claim 24 and further comprising:

scheduling a wireless communication between the any candidate bridge platform and the another candidate bridge platform to facilitate transferring data as collected from the specific one of the clusters.

* * * * *